United States Patent [19]

Amundson et al.

[11] Patent Number: 5,005,603

[45] Date of Patent: Apr. 9, 1991

[54] RETROFITTABLE SEWER TRAP

[76] Inventors: Eric K. Amundson, Rd. 2 Box 147; Herbert C. Manners, Rd. 1 Box 5, both of Punxsutawney, Pa. 15767

[21] Appl. No.: 369,765

[22] Filed: Jun. 22, 1989

[51] Int. Cl.[5] ..... F16K 31/22; F16K 25/00

[52] U.S. Cl. ..... 137/192; 137/433; 4/287; 251/85; 251/87

[58] Field of Search ..... 4/286, 287, 288; 137/315, 202, 430, 433, 454.2, 192; 251/85, 87

[56] References Cited

U.S. PATENT DOCUMENTS

| | | | |
|---|---|---|---|
| 576,790 | 2/1897 | O'Brien | 137/433 |
| 1,211,283 | 1/1917 | Butler | 137/433 |
| 1,423,679 | 7/1922 | Pavitchich | 137/433 |
| 1,623,515 | 4/1927 | Workman | 137/433 |
| 2,524,501 | 10/1950 | Wilhelm | 137/433 |
| 2,531,721 | 11/1950 | Brock | 137/433 |
| 2,787,376 | 4/1957 | Coulson | 137/433 |
| 2,843,146 | 7/1958 | Kirschner | 137/433 |
| 2,915,083 | 12/1959 | Kunkel et al. | 137/433 |
| 3,227,173 | 1/1966 | Bernstein | 137/192 |
| 4,088,149 | 5/1978 | Logsdon | 137/433 |

FOREIGN PATENT DOCUMENTS

| | | | |
|---|---|---|---|
| 1554980 | 10/1979 | United Kingdom | 137/433 |

*Primary Examiner*—George L. Walton

*Attorney, Agent, or Firm*—Reed Smith Shaw & McClay

[57] ABSTRACT

A retrofittable drain insert for existing bell shaped traps and other type drains is provided. The drain insert enables an existing bell trap or pipe drain to be modified and upgraded easily by not only preventing the backflow of sewer gases but also by substantially reducing the backflow of fluid through the drain into the drained area. The drain insert includes a housing with a valve means suspended by an expandable suspension means which easily fits into and can be mounted within the existing drain opening. The valve means has a larger diameter than the housing so as to form a gas tight and fluid tight seal, however, it has a smaller diameter than the existing drain opening so as easily to be retrofittable and fit therein.

18 Claims, 4 Drawing Sheets

RETROFITTABLE SEWER TRAP

FIELD OF THE INVENTION

The present invention relates to drains and traps used in conjunction with sewers and more particularly to an improved drain or trap insert which can be used in an existing sewer or drain.

BACKGROUND OF THE INVENTION

"Bell" shaped sewer traps and drains are used in nearly every home and business in the United States. These traps have been used for many years as a means of preventing sewer gases from entering the building via the drainage system. The bell trap functions by holding a small amount of water in a reservoir. The drain cover extends into the water, thereby sealing off the sewer gases. If the drain is not used frequently, for example, if it is in a warm basement where the furnace is located, the water in the bell trap can evaporate quickly, thereby eliminating the seal with the bell of the drain cover and allowing sewer gases to escape up through the drain and into the house. This is very undesirable, particularly because of the unpleasant odor of sewer gases. Also, gas-tight bell traps have no provision for stopping water or other fluids from entering the building from backed-up drains. It would be desirable if a bell trap could prevent the backflow of fluids in addition to gases.

The same problems of the backflow of unpleasant fluids and gases can also occur in other types of drains and particularly pipe drains. In pipe drains there is often no trap provided for preventing the backflow of liquids and gases. It would be desirable to have a trap insert which could be retrofitted into the pipe drain to prevent the backflow of fluids and gases.

Many prior art methods have been used to prevent the backflow of liquids and gases. Such devices are shown in U.S. Pat. Nos. 3,542,057; 4,485,844; 2,348,097; 3,160,112, 3,791,401, 4,212,314, 3,173,442, 1,109,740 and 539,689. The drain plug in U.S. Pat. No. 3,542,057 uses a moveable valve member which is held closed by a spring to prevent the backflow of liquids and gases. These devices, however are cumbersome and not easily retrofitted into existing bell-shaped drains or traps. Existing retrofit devices such as that manufactured by Dranjer Corp., of Winnipeg, Manitoba, are expensive and generally need to be installed by a contractor or professional. Additionally, the Dranjer device appears to require smashing the existing drain out in order to make room for the new insert.

Accordingly, it would be desirable to have a trap insert which would enabled new or existing bell shaped traps and other types of drains to be easily and inexpensively retrofitted to eliminate the possibility of the backflow of gas and also to prevent the backflow of liquid from the sewer system.

SUMMARY OF THE INVENTION

The present invention solves many of the problems of existing bell traps and other types of drains such as pipe drains by providing a retrofittable drain insert which may be used on existing trap or drain to substantially prevent the backflow of gases and fluids through the drain into the drained area. The drain insert includes a hollow housing which is sized to be inserted into the bell trap or other type drain and secured therein with a sealant. The sizing of the housing can be adjusted through the use of different diameter bushings placed around the hollow core. The housing preferably has a lip which assists in positioning and securing the housing within the existing drain. The invention also includes a valve means which is extendably suspended from the housing. The valve means has a larger diameter than the housing inside diameter and is normally retracted partially within the housing to create a substantially gas tight and fluid tight seal between the valve means and the housing. The valve means, however, does not have a larger diameter than the existing drain opening, allowing the retrofittable insert easily to be placed therein. When fluid enters the drain, the valve means is displaced away from the housing, opening the seal and permitting the fluid to drain. Once the fluid is drained, the valve means is retracted into the housing, reforming the seal and thereby preventing the backflow of gas and fluid through the drain.

The retrofittable insert of the present invention when installed completely stops or substantially reduces the amount of sewer gas and water or other fluid from backflowing through the bell trap or other type drain into the building, while not inhibiting the drain's ability to allow water or other fluids to go down the drain to the sewer. Unlike the conventional bell trap drains, the retrofittable insert does not require water to be stored in the reservoir in order to function properly and provide a gas tight seal.

The drain insert of a preferred embodiment of the present invention is lightweight, durable and can be produced relatively inexpensively. The drain insert can be installed relatively quickly and easily by any handy person. The insert is especially designed to fit existing bell trap drains made of PVC, cast iron or aluminum although it can work with other materials depending on the adhesive chosen. The drain insert can also be inserted into a pipe drain which does not utilize a bell trap. The drain insert may easily be cleaned by removing the drain cover and washing the insert out with a hose.

Other details, objects and advantages of the invention will become apparent as the following description of the presently preferred embodiments and presently preferred methods of practicing the invention proceeds.

BRIEF DESCRIPTION OF THE DRAWINGS

In the accompanying drawings, the preferred embodiments of the invention and preferred methods of practicing the invention are illustrated in which:

FIG. 3 illustrates a cross sectional view of the drain insert of FIG. 1 showing the fluid flow there through;

DETAILED DESCRIPTION OF THE INVENTION

The present invention relates to a drain which has been fitted with a drain insert which is capable of preventing gas and fluids from backflowing through the drain while simultaneously permitting the drain to function properly. Preferably, the drain insert is designed to be retrofittable in existing bell-shaped traps and drains. It can also be retrofitted in existing pipe type drains.

Figure 1:
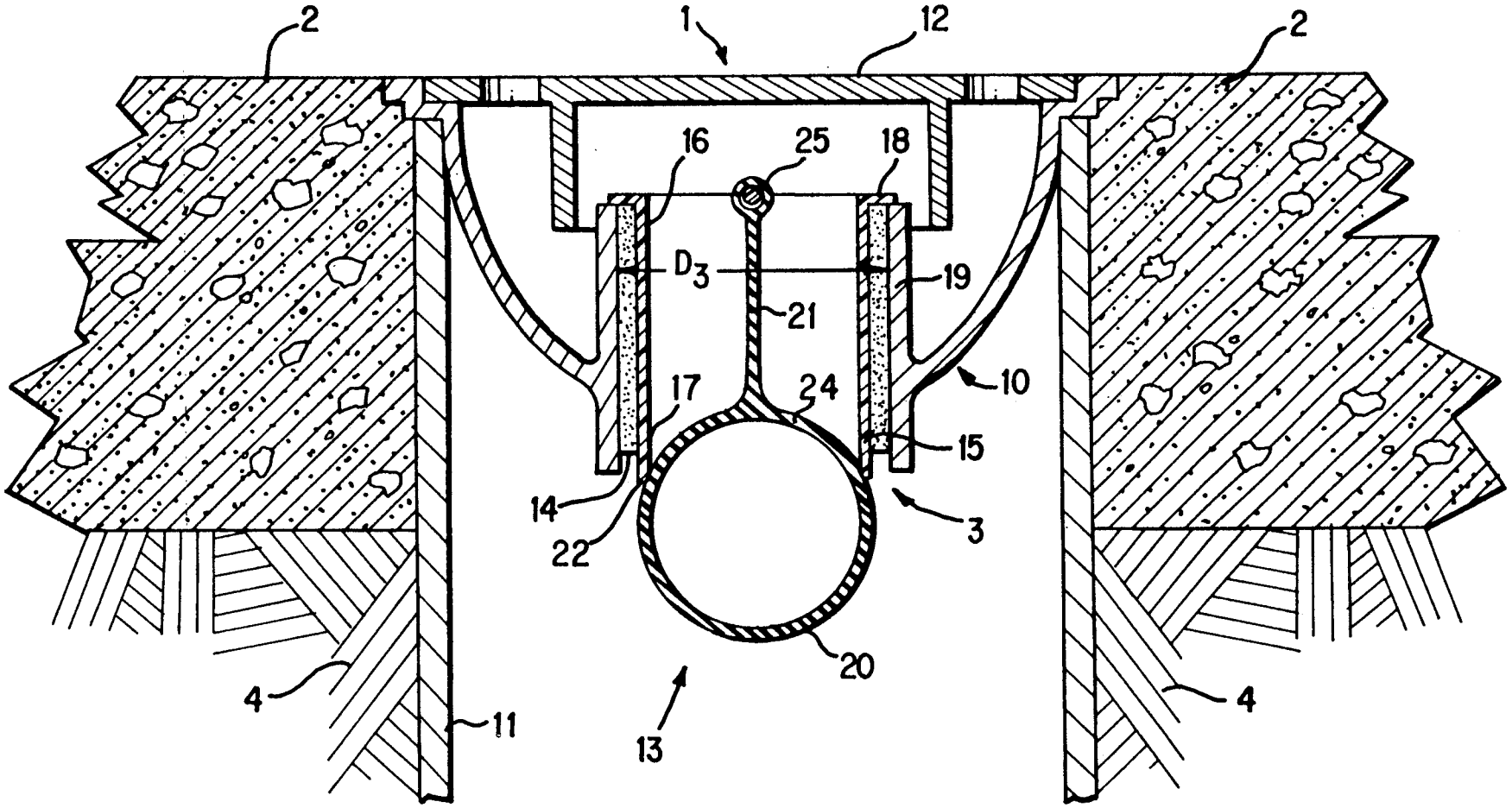
FIG. 1 illustrates a cross sectional view of a drain insert of the present invention in a bell trap.

One preferred embodiment of the invention is illustrated in FIG. 1, which shows an existing drain 1 and a drain opening 3 in a concrete floor 2 such as is found in the basement of a house. The existing drain 1 has a bell-shaped trap, generally 10, within an existing drain pipe, generally 11, covered by an existing drain cover 12. The drain pipe 11 extends into the ground 4 beneath the concrete floor 2. As illustrated, the drain insert of the present invention, generally 13, may be retrofitted into the existing drain by simply removing the drain cover 12 and inserting the drain insert 13 within the bell trap 10 and securing and sealing the drain insert 13 therein with a sealing means, such as glue and/or sealer 14 which is preferably applied around the entire exterior of the housing 15.

The drain insert 13 itself includes a housing 15, which is preferably cylindrical, but could be any shape corresponding with the shape of the bell trap 10. As shown, the housing has an upper end 16 and a lower end 17. The upper end preferably includes a lip 18 which extends peripherally around the upper end 16 of the housing 15 and permits the housing 15 to be supported within the drain opening 3. As illustrated in FIG. 1, the lip rests on the standpipe 19 of the bell trap 10 which forms drain opening 3.

Figures 2, 4, 5, 6:
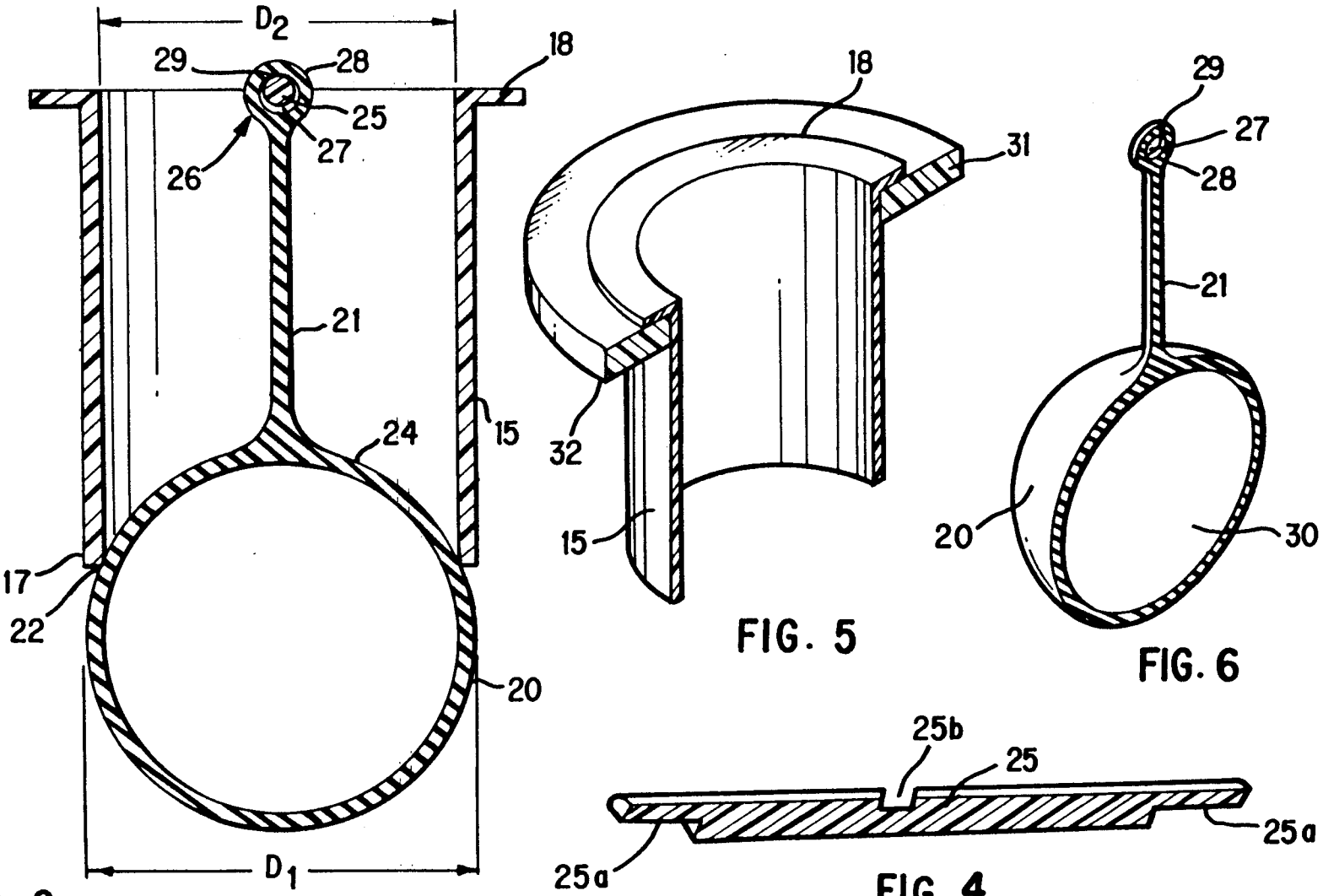
FIG. 2 illustrates a detailed cross sectional view of the drain insert shown in FIG. 1.
FIG. 4 illustrates a cross sectional isometric view of a preferred suspension bar used in the drain insert shown in FIG. 2.
FIG. 5 illustrates a cross sectional isometric view of a preferred housing used in the drain insert of FIG. 2 with a bushing added.
FIG. 6 illustrates a cross sectional isometric view of a preferred valve means used in the drain of FIG. 2.

The drain insert 13 further includes a valve means 20, generally a curved and preferably a spherical member, which extends beneath the housing 15. As illustrated in FIG. 2, the valve means 20 has an outside diameter $D_1$ which is greater than the inside diameter $D_2$ of the housing 15 and which is smaller than the inside diameter $D_3$ of drain opening 3. (See also FIG. 1). The upper portion 24 of valve means 20 has a smaller diameter than the inside diameter $D_2$ of the housing 15 which permits the upper portion 24 of the valve means 20 to ride within the housing 15. The valve means 20 is dimensioned and shaped such that a portion of the exterior of it substantially conforms to the opening in the lower end of housing 15 to form a substantially gas tight and fluid tight seal 22.

Figure 7:
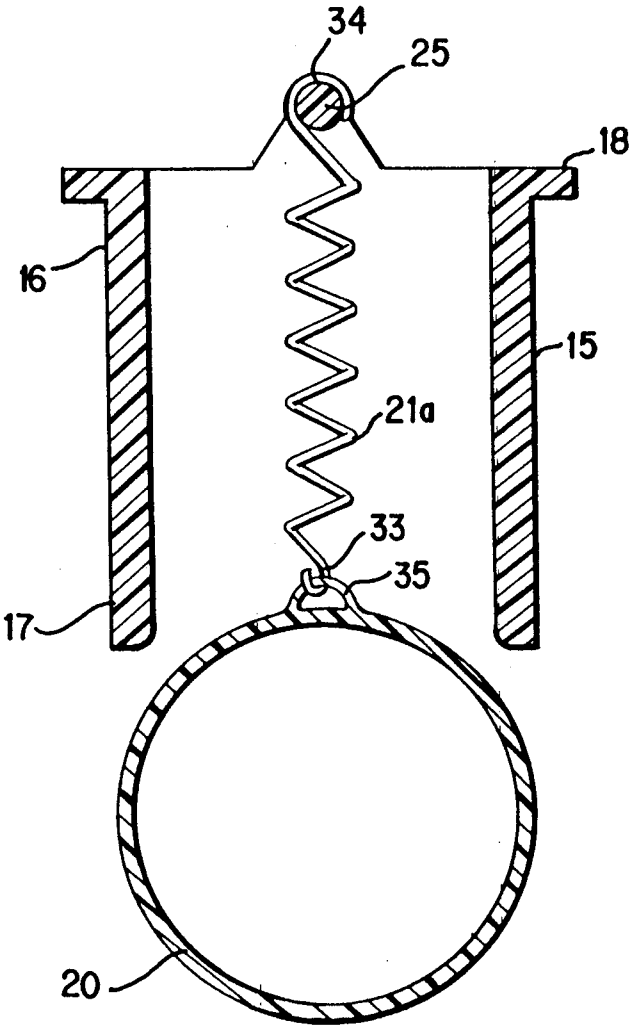
FIG. 7 shows another embodiment of the drain insert of the present invention.

The valve means 20 is held against the lower end 17 of the housing 15 by an expandable suspension means 21. In one embodiment the suspension means may be fabricated of any durable expandable material such as rubber. Alternatively the expandable suspension means may be a spring 21*a* as shown in FIG. 7. Preferably, a resilient material which does not corrode or deteriorate over time in a damp environment should be used. The suspension means 21 is normally in slight tension such that the suspension means holds the valve means 20 snuggly against the lower end 17 of the housing 15 and the gas and fluid tight seal 22 forms where the valve means 20 and the housing 15 meet. Valve means 20 is able to form a seal with lower end 17 whereas it would not be able to form a seal with the lower end of standpipe 19 due to its very rough lower edge.

Figure 3:
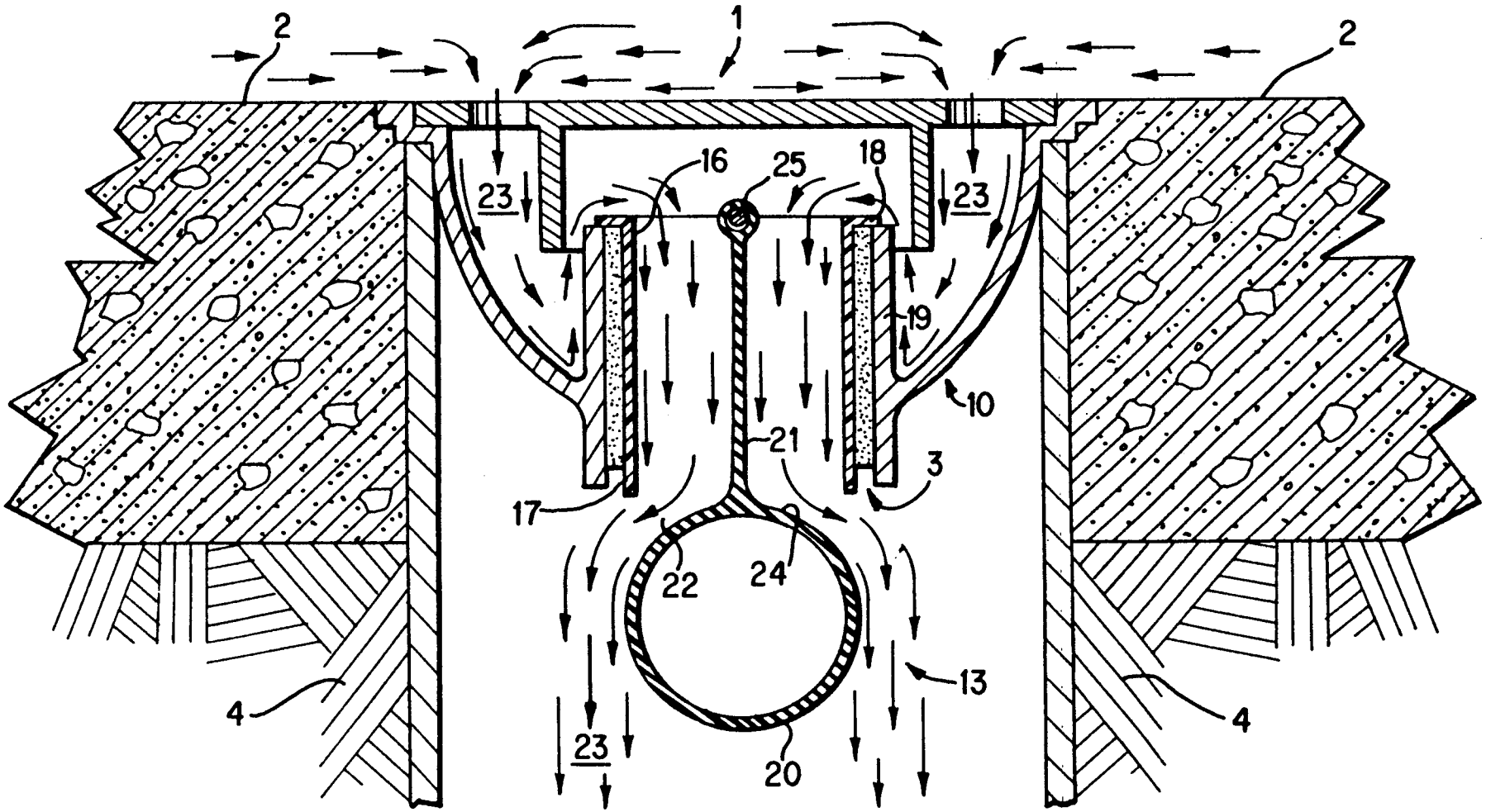

As illustrated in FIG. 3, when water or other fluid 23 enters the drain 1, the fluid 23 passes into the bell trap 10 and spills over the upper end 16 of the housing 15 and falls onto the upper portion 24 of the valve means 20 and weighs the valve means down, thereby extending the suspension means 21 and opening the seal 22 such that the fluid 23 may flow out of the lower end 17 of the housing 15. When the fluid 23 stops flowing through the housing 15, the suspension means 21 retracts the valve means 20 back into contact with the lower end 17 of the housing 15 reforming the seal 22 therebetween. Once formed, this seal 22 prevents gasses such as sewer gasses, radon, etc., as well as fluids from backflowing through the drain 1.

As illustrated in FIG. 2, the valve means 20 is preferably suspended from the housing 15 by a suspension bar 25, which rests on the lip 18 of the housing 15. As illustrated in FIG. 4, the suspension bar 25 may include notched ends 25*a*, which permit the bar 25 to rest on the lip 18 without rolling or moving laterally with respect to the housing 15. As shown in FIG. 2, the suspension means 21 is preferably pivotally connected to the suspension bar 25. The pivotal connection, generally 26, comprises an opening such as hole 27 in the end 28 of the suspension means, with the suspension bar 25 passing through the hole 27. As shown, the suspension bar preferably has at least a partially curved surface 29 permitting the suspension means 21 to pivot more easily about the suspension bar 25.

FIG. 5 illustrates a portion of the preferred embodiment of the housing 15 in more detail, showing the lip 18 and bushing 31 which support the drain insert 13 on standpipe 19 of the drain 1. The housing 15 is preferably constructed from a durable material such as PVC, and is dimensioned and shaped to be easily inserted within the drain opening 3. Also shown in FIG. 5 is a bushing 31 which can be fixedly attached to housing 15 to enable it to be used in a variety of different size drain openings 3. Bushing 31 which can be of various diameters is particularly useful in adapting the housing 15 so that it can fit in drain pipes having a much larger diameter than the diameter of housing 15. Preferably bushing 31 is glued to housing 15 and has an edge 32 which rests on the sides of the drain pipe 11 or standpipe 19.

A detail of a preferred embodiment of the valve means 20 and suspension means 21 is illustrated in FIG. 6. As shown therein, the valve means 20 may be spherical and may have a hollow center 30. However, the valve means need not be spherical and may be any shape which allows the valve means to substantially conform to the lower end of the housing such that a seal 22 between the lower end 17 and the valve means 20 is formed. Preferably, the valve means 20 is constructed from the same resilient material as the suspension means 21, such as rubber or other elastic material, such that the suspension means and valve means may be integrally formed.

FIG. 7 shows another embodiment of the drain insert of the present invention with a stainless steel spring 21*a* used as the suspension means. The lower end of the spring 21*a* forms a hook 33 which is connected to loop 35 which in turn is attached to the top of valve means 20. The upper end of the spring 21*a* also forms a hook 34 which fits around suspension bar 25 and preferably into groove 25*b* in the center thereof which helps hold the spring 21*a* in place.

Figure 9:
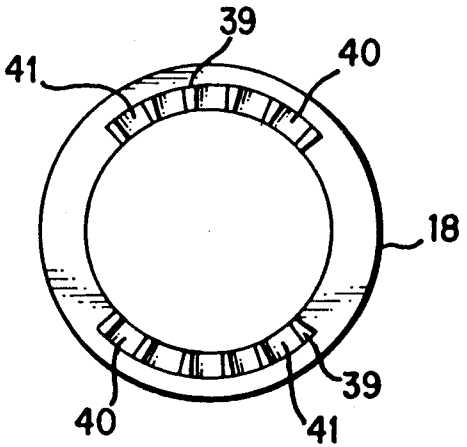
FIG. 9 shows a top view of the tightening means shown in FIG. 8.
Figure 8:
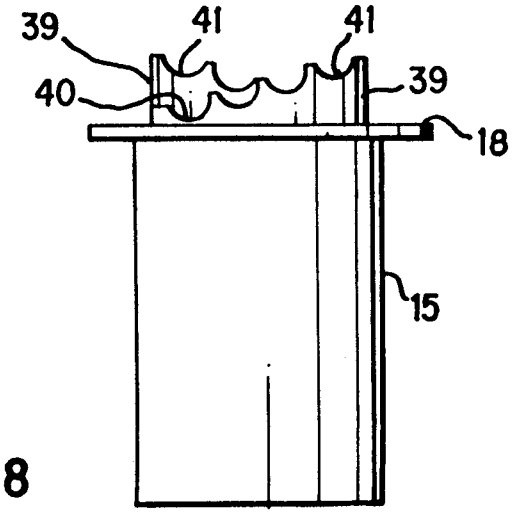
FIG. 8 shows a tightening means mounted on top of the drain insert of the present invention.

FIGS. 8 and 9 show one mechanism for increasing the tension in suspension means 21 or spring 21*a* after installation. The tensioning means in this embodiment is comprised of stepped members 39 located on top of housing 15 across from each other. Initially, the ends of suspension bar 25 are placed in the lowermost notches 40. If it is desired to increase the tension in spring 21*a* or suspension means 21, the suspension bar 25 can be moved in increments to the highest notches 41. At each notch up on the stepped members 39, the tension increases thereby forming a tighter seal 22. In another embodiment (not shown) there are three stepped members on the housing and the suspension bar is approximately Y-shaped. This design can prevent the suspension bar from inadvertently falling into the housing if the Y is made large enough.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. A retrofittable drain insert capable of preventing gas and fluid from backflowing through a drain having a drain opening and permitting said drain to drain fluid therefrom, said insert comprising a cylindrical housing dimensioned and shaped to be retrofittable within said drain, said housing having an upper end, a lower end, a suspension means and a valve means, said housing upper end having a suspension receiving means disposed thereon, said valve means being on one end of said suspension mean sand having an outside diameter exceeding the inside diameter of said housing but smaller than the diameter of the drain opening, said valve means being held against the lower end of said cylindrical housing by said suspension means, said suspension means being formed of a resilient material, said suspension means other end being pivotally and selectively positioned by said receiving means such that said valve means achieves selective gas tight and fluid tight seals with said cylindrical housing, said suspension means expanding to open said seal when fluid passes through the upper end of said housing.

2. A drain insert as described in claim 1 wherein the valve means and suspension means are integrally formed from the same resilient material.

3. A drain insert as described in claim 1 wherein the suspension means is a spring.

4. A drain insert as described in claim 1 wherein said housing includes a lip at the upper end permitting said housing to rest within said drain.

5. A drain insert as described in claim 4 wherein said valve means is suspended by said suspension means from a suspension bar, said suspension bar having two notched ends for resting on said lip of said housing.

6. A drain insert as described in claim 5 wherein said suspension means is pivotally connected to said suspension bar by means of an opening at the end of said suspension means, said suspension bar passing through said opening, said suspension bar having at least a partially curved surface permitting said suspension means to pivot about said suspension bar for maintaining a true alignment between the valve means and the lower end of the cylindrical housing to always provide an effective seal therebetween.

7. A drain insert as described in claim 6 wherein the suspension bar has a groove wherein a portion of the suspension means rests.

8. A drain insert as described in claim 1 wherein said valve means comprises a curved member.

9. A drain insert as described in claim 1 further comprising a means for adjusting the tension in the suspension means which comprises a plurality of grooves in the cylindrical housing for selectively positioned the suspension means to adjust the tension.

10. A retrofittable insert for a bell trap drain having a drain opening, said insert comprising: a cylindrical housing, said housing having an upper end and a lower end; an expandable suspension means; a valve means being on one end of said suspension means, said valve means diameter being smaller than the diameter of the drain opening but exceeding the inside diameter of said cylindrical housing; said housing upper end having a suspension receiving means disposed thereon; said expandable suspension means being formed of a resilient material and located substantially within the cylindrical housing, said suspension means other end being pivotally and selectively positioned by said receiving means such that said valve means is held against said lower end of said cylindrical housing and achieves selective gas tight and fluid tight seals with said lower end of said cylindrical housing, and wherein said expandable suspension means expends to open said seal when fluid passes downwardly through said upper end of said cylindrical housing thereby allowing fluid to drain from said lower end of said cylindrical housing.

11. The drain insert as described in claim 10 wherein said upper end of said housing includes a lip for supporting said housing within said drain opening.

12. The drain insert as described in claim 10 wherein said upper end of said housing includes a bushing for supporting said housing within said drain opening.

13. The drain insert as described in claim 11 wherein said valve means is suspended by said suspension means from a suspension bar, said suspension bar having two notched ends for resting on said lip of said housing.

14. The drain insert as described in claim 13 wherein said suspension means is pivotally connected to said suspension bar by means of a circular hole at the end of said suspension means, said suspension bar passing through said hole, said suspension bar having at last a partially curved surface and a groove therein permitting said suspension means to pivot about said suspension bar for maintaining a true alignment between the valve means and the lower end of the cylindrical housing to always provide an effective seal therebetween.

15. The drain insert as described in claim 10 wherein said valve means comprises a spherical member.

16. The drain insert as described in claim 10 wherein the valve means and suspension means are integrally formed from the same resilient material.

17. The drain insert as described in claim 10 wherein the suspension means comprises a spring.

18. The drain insert as described in claim 10 wherein said housing is secured within said drain opening with a sealing means.

* * * * *